US011938389B2

(12) United States Patent
Usher

(10) Patent No.: US 11,938,389 B2
(45) Date of Patent: Mar. 26, 2024

(54) GAME BAG DEVICE

(71) Applicant: Michael Usher, Rock Hill, SC (US)

(72) Inventor: Michael Usher, Rock Hill, SC (US)

( * ) Notice: Subject to any disclaimer, the term of this patent is extended or adjusted under 35 U.S.C. 154(b) by 79 days.

(21) Appl. No.: 17/509,500

(22) Filed: Oct. 25, 2021

(65) Prior Publication Data

US 2023/0128677 A1 Apr. 27, 2023

(51) Int. Cl.
*A63B 67/06* (2006.01)
*A63B 37/08* (2006.01)

(52) U.S. Cl.
CPC ..... *A63B 67/06* (2013.01); *A63B 37/08* (2013.01); *A63B 2037/082* (2013.01)

(58) Field of Classification Search
CPC . A63B 27/02; A63B 2037/082; A63B 43/002; A63B 65/00; A63B 67/06; A63B 37/02; A47G 9/10
See application file for complete search history.

(56) References Cited

U.S. PATENT DOCUMENTS 765,519 A * 7/1904 Sperry ..... A47G 9/10 428/6
2,105,861 A * 1/1938 Klecka ..... A63B 43/002 473/598
3,977,121 A * 8/1976 Goldfarb ..... A63H 3/00 446/369
4,151,994 A 5/1979 Stalberger, Jr.
4,943,066 A * 7/1990 Lathim ..... A63B 37/02 473/576
5,316,310 A * 5/1994 Nicholas, Sr. ..... A63F 9/0204 473/588
5,332,230 A * 7/1994 Benedict ..... A63B 67/06 273/DIG. 30
6,931,682 B2 * 8/2005 Kruger, Jr. ..... A47G 9/1081 5/636
7,222,379 B2 * 5/2007 DiGirolamo ..... A47G 9/10 5/636
7,520,830 B2 * 4/2009 Wong ..... A63B 43/04 473/594
10,953,295 B2 3/2021 Modlin

FOREIGN PATENT DOCUMENTS

WO WO-0122852 A1 * 4/2001 ..... A47G 9/10

* cited by examiner

*Primary Examiner* — Laura Davison
(74) *Attorney, Agent, or Firm* — PATENTFILE, LLC; Bradley C. Fach; Steven R. Kick

(57) ABSTRACT

A game bag device may include a body having a first body sidewall and a second body sidewall. The first and second body sidewalls may be coupled together to form a body cavity. One or more core structures may be coupled to the body, and each core structure may define a core cavity. A core filler may be disposed withing the core cavity. A body filler may be disposed within the body cavity. Optionally, the device may include a core structure that may be positioned within a core cavity and/or a core structure that may be positioned external to a core cavity. Optionally, a core structure may include an aperture and may be coupled to the body sidewalls within a core cavity so that the device may include an aperture cavity that may include an aperture filler.

7 Claims, 12 Drawing Sheets

GAME BAG DEVICE

FIELD OF THE INVENTION

This patent specification relates to the field of gaming devices. More specifically, this patent specification relates to a game bag device which may be used for skill toss and throwing games, such as cornhole.

BACKGROUND

Many games require players to throw objects at targets. The game of cornhole is an example, in which players throw or toss bean bags at a gameboard having a hole or cut out in order to score points by having their bags enter the gameboard hole or cut out. During the throwing process, the thrower winds up and releases. During this windup and release, the beads in a traditional bag move freely within the bag. Through the process of the throw, momentum shifts directions and as it does, the beads that are held by the hand tend to roll off the hand and displace around the hand, thus causing the center of gravity of the bag to shift, sometimes dramatically. The shifting of the bag can cause inconsistent throws which can lead to lost games and frustration. Therefore, a need exists for novel game bag devices which may be used for skill toss and throwing games, such as cornhole.

BRIEF SUMMARY OF THE INVENTION

A game bag device is provided which provides stability of the bag device when holding and throwing. The various embodiments also provide the thrower with various landing strategies when the bag comes in contact with the board; e.g., improved sliding, roll bag, blocker bag, hanger bag. These strategies are made possible by the various designs through the center of gravity of the bag device being affected by one or more core structures. By providing areas inside or about the bag device that are more densely packed with filler material, the center of gravity remains constant in the hand. Since there are areas in or about the bag device that have less densely packed filler material, the bag device is still able to perform similar to a standard bag once on the board; e.g., flexible movement, not a completely stiff. The game of cornhole consists of several strategies. One of which is bag placement and blocking on the board. Through various designs and placement of the dense/non-dense materials, the game bag device can achieve consistent blocking and sliding results.

In some embodiments, the device may include: a first sidewall that may be coupled to a second sidewall; a body cavity; a first core structure disposed in the body cavity, the core structure defining a core cavity; a core filler disposed within the core cavity; and a body filler disposed within the body cavity.

In further embodiments, the core filler may have a core average particle size, the body filler may have a body average particle size, and there may be at least a five percent difference between the core average particle size and the body average particle size.

In further embodiments, the core filler may have a core average particle weight, the body filler may have a body average particle weight, and there may be at least a five percent difference between the core average particle weight and the body average particle weight.

In further embodiments, the core filler may have a core density, the body filler may have a body density, and there may be at least a five percent difference between the core density and the body density.

In further embodiments, the device may include: a first sidewall that may be coupled to a second sidewall; a body cavity; a core structure defining a core cavity, the core structure having an aperture; a core filler disposed within the core cavity; and a body filler disposed within the body cavity.

In further embodiments, the core structure may be coupled to the first sidewall and the second sidewall, and an aperture cavity, having an aperture filling, may be formed within the aperture between the first sidewall and the second sidewall.

In further embodiments, the aperture filler may have an aperture density, the body filler may have a body density, and there may be at least a five percent difference between the aperture density and the body density. may have In further embodiments, the aperture filler may have an aperture density, the core filler may have a core density, and there may be at least a five percent difference between the aperture density and the core density.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
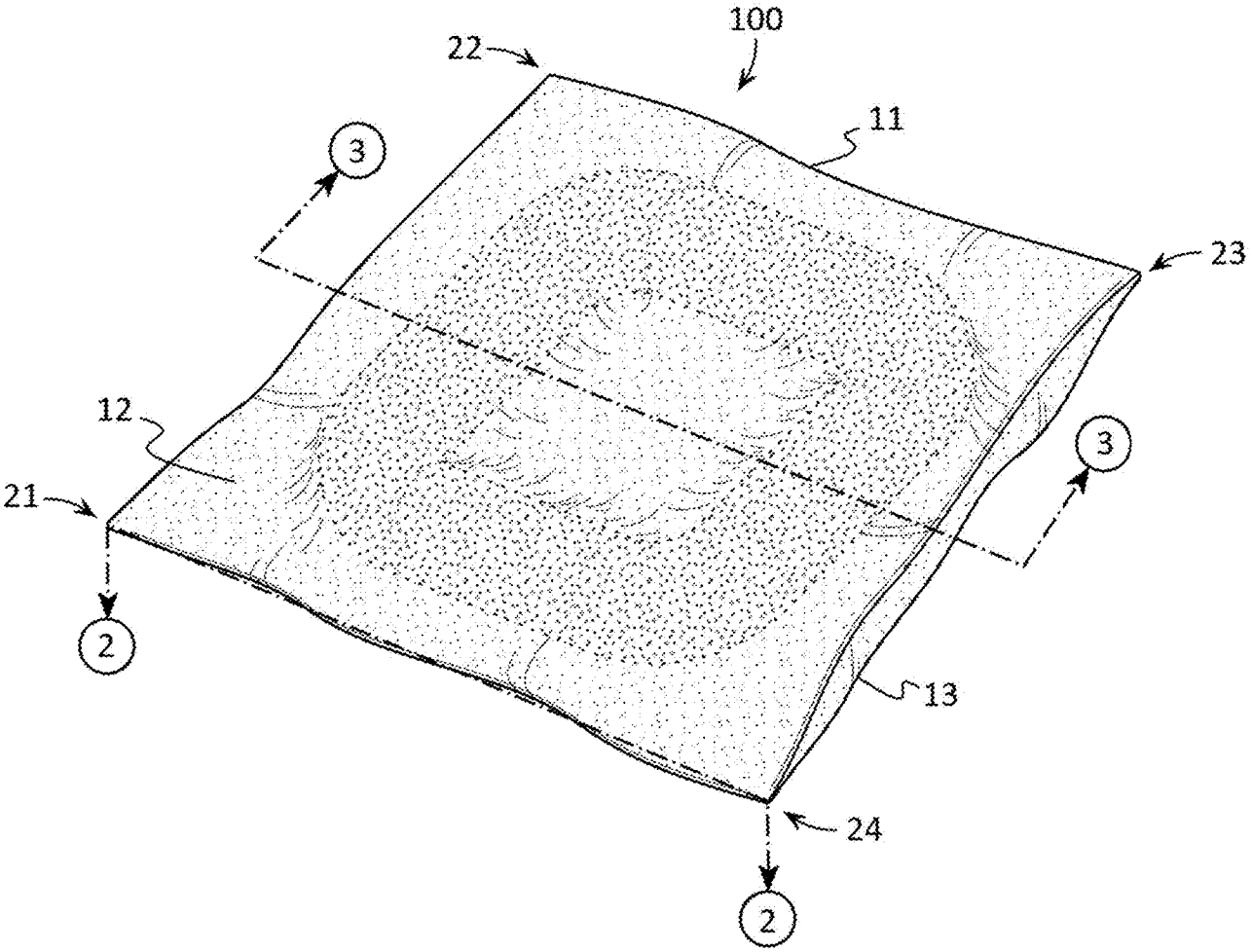
FIG. 1 depicts a perspective view of an example of a game bag device with texturing to show the positioning of a core structure within a body cavity according to various embodiments described herein.
Figure 2:
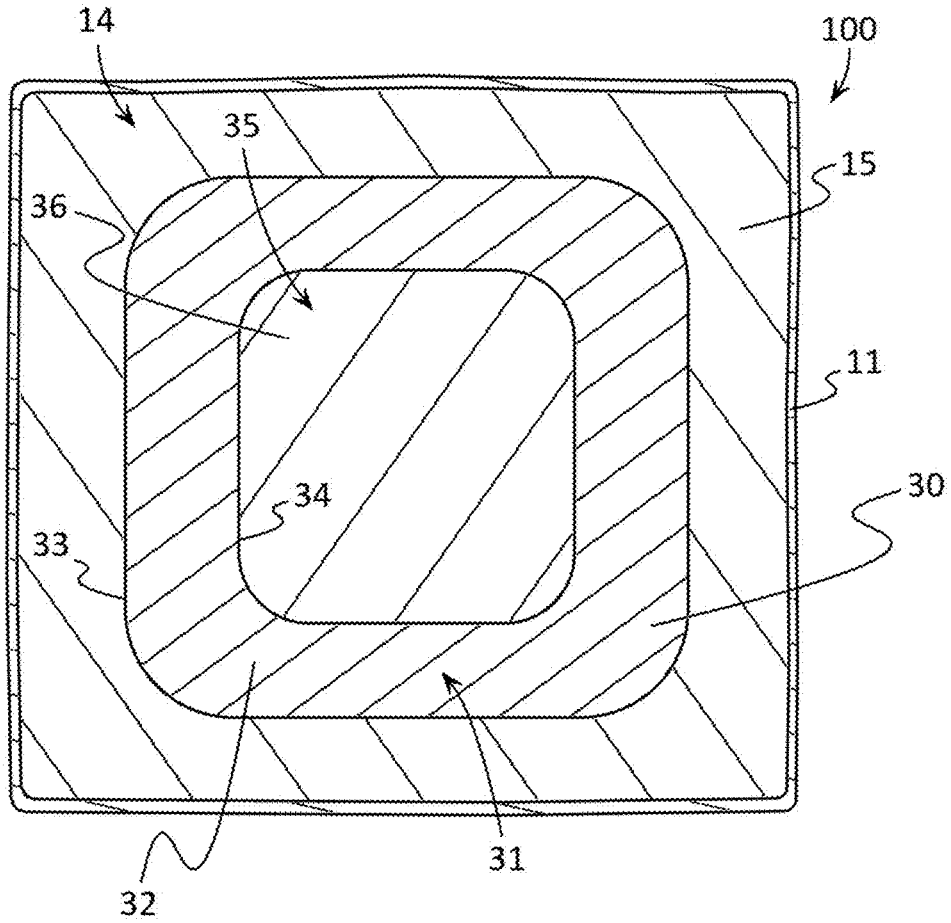
FIG. 2 illustrates a sectional, through line 2-2 shown in FIG. 1, plan view of an example of a game bag device according to various embodiments described herein.
Figure 3:
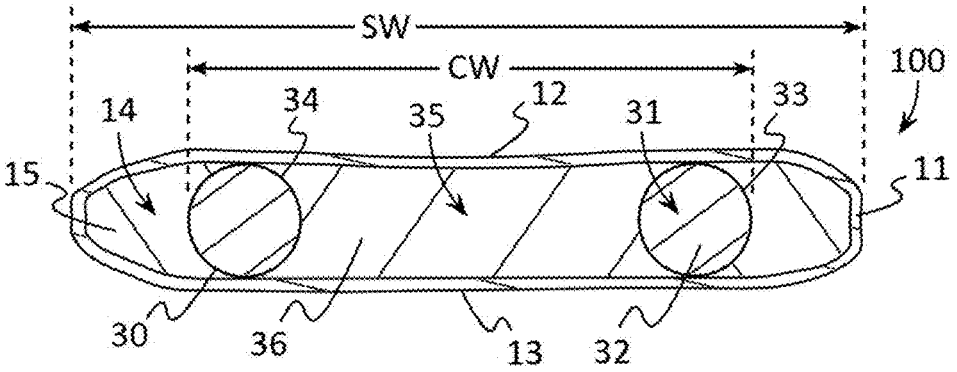
FIG. 3 shows a sectional, through line 3-3 shown in FIG. 1, elevation view of an example of a game bag device according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within 10% of the actual desired value, more preferably within 5% of the actual desired value, and more preferably within 1% of the actual desired value of any variable, element or limit set forth herein.

A new game bag device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-18 illustrate examples of a game bag device ("the device") 100, 100A, 100B, 100C, 100D, 100E, according to various embodiments. In some embodiments, the device 100, 100A, 100B, 100C, 100D, 100E, may comprise a body 11 having a first body sidewall 12 and a second body sidewall 13. The first 12 and second 13 body sidewalls may be coupled together to form a body cavity 14. One or more core structures 30 may be coupled to the body 11, and each core structure 30 may define a core cavity 31. A core filler 32 may be disposed withing the core cavity 31. A body filler 15 may be disposed within the body cavity 14.

Generally, the body 11 may comprise one or more body sidewalls 12, 13, which may be coupled together to form the shape of the body 11 and to form the body cavity 14 of the body 11. Body sidewalls 12, 13, may be configured in any size and shape and may be coupled together with any suitable coupling method to form a body 11 and body cavity 14 of any size and shape. In preferred embodiments, the body 11 may comprise a first or upper body sidewall 12 and second or lower body sidewall 13 each having a rectangular shape, and the perimeters of the first 12 and second 13 body sidewall may be coupled together, such as via stitching, to form a generally rectangular prism shaped body 11 and body cavity 14. In further preferred embodiments, the first 12 and second 13 body sidewall may be coupled together, such as via stitching, to result in the coupled first 12 and second 13 body sidewalls each having a generally square shape. In further embodiments, a first body sidewall 12 and second body sidewall 13 may be formed from a single rectangular shaped unit of material which may be folded approximately in half and the three open sides of the body sidewalls 12, 13, may be coupled together, such as via stitching, to form a generally rectangular prism shaped body 11 and body cavity 14.

In further preferred embodiments, the body 11 may comprise a first or upper body sidewall 12 and second or lower body sidewall 13 each having a rectangular shape, and the perimeters of the first 12 and second 13 body sidewall may be coupled together, such as via stitching, to form a generally rectangular prism shaped body 11 having a first corner 21, a second corner 22, a third corner 23, and a fourth corner 24. Optionally, corners 21, 22, 23, 24, may be rounded, such as by being rounded 0.5 inches or less.

Optionally, the device 100, 100A, 100B, 100C, 100D, 100E, may comprise two or more body cavities 14, such as which may be formed by dividing a larger body cavity 14 into two or more smaller body cavities 14, such as by having a third body sidewall or any other number of body sidewalls coupled to the first 12 and second 13 body sidewalls.

The body sidewalls 12, 13, may be made from or may comprise a flexible material which may allow the shape of the body 11 to be generally fluid and easily bent, folded, bunched, etc. In preferred embodiments, body sidewalls 12, 13, may be made from or may comprise a flexible cloth material, such as woven cotton fabric, woven linen fabric, woven polyester fabric, neoprene fabric, elastomeric coated fabric, microfiber fabrics, suede, other woven fabrics, other non-woven fabrics, other knitted fabrics, or some other strong and durable material known in the art.

The device 100, 100A, 100B, 100C, 100D, 100E, may comprise a body filler 15 which may be disposed within the body cavity 14. Generally, the body filler 15 may comprise a plurality of small objects or particles which may act as a fluid or undergo fluid movement within the body cavity 14. For example, body filler 15 may comprise dry corn feed, dry beans, plastic pellets, plastic spheres, rubber pellets, rubber spheres, metal pellets, metal spheres, metal coated in plastic spheres, metal coated in plastic pellets, styrene pellets, styrene spheres, polystyrene pellets, polystyrene spheres, or some other similar filling. The body filler 15 may comprise a body average particle size which may describe the average particle size or volume of the individual particles of the body filler 15. For example, body average particle size may range from 0.1 to 15 millimeters, although any size may be used. The body filler 15 may comprise a body average particle weight which may describe the average particle weight of the individual particles of the body filler 15. The body filler 15 may comprise a body density which may be determined by the mass of the body filler 15 divided by the volume of the body cavity 14 that the body filler 15 is able to move in or occupy.

The device 100, 100A, 100B, 100C, 100D, 100E, may comprise one or more core structures 30 which may be positioned inside and/or outside of a body cavity 14. It should be understood that the suffixes of "A", "B", "C", etc., on the number of an element designate different embodiments of the element. For example, the core structures 30A, 30B, 30C, 30D, etc., read on the teachings of core structure 30.

Figure 4:
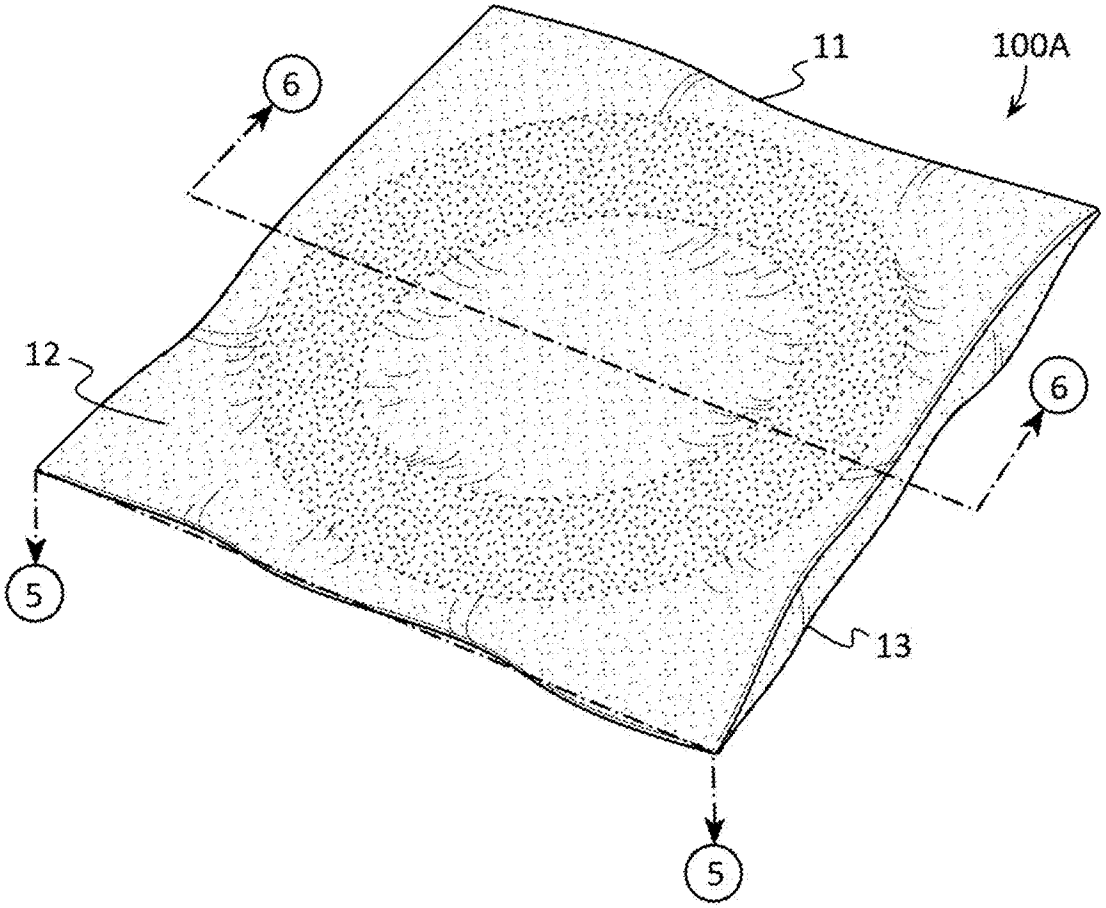
FIG. 4 depicts a perspective view of another example of a game bag device with texturing to show the positioning of a core structure within a body cavity according to various embodiments described herein.
Figure 5:
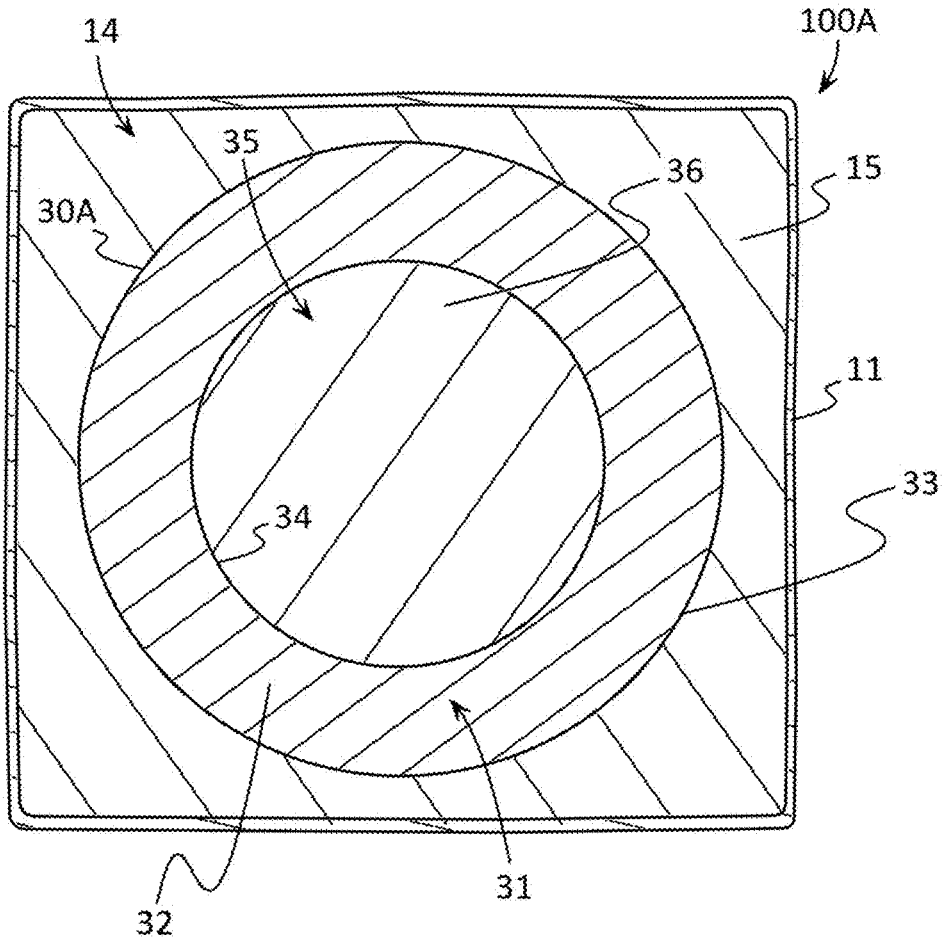
FIG. 5 illustrates a sectional, through line 5-5 shown in FIG. 4, plan view of another example of a game bag device according to various embodiments described herein.
Figure 6:
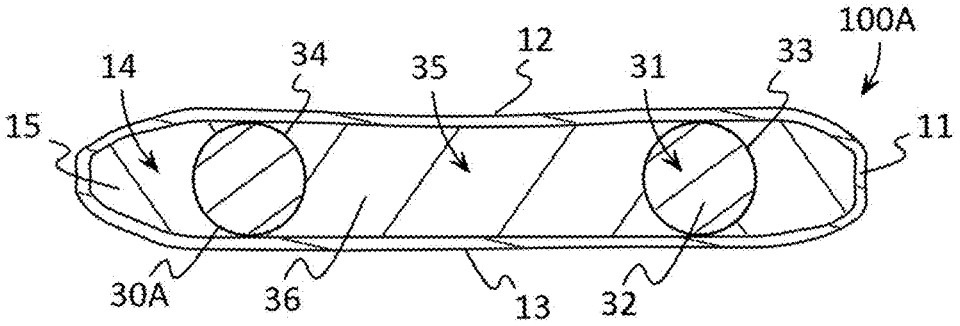
FIG. 6 shows a sectional, through line 6-6 shown in FIG. 4, elevation view of another example of a game bag device according to various embodiments described herein.
Figure 7:
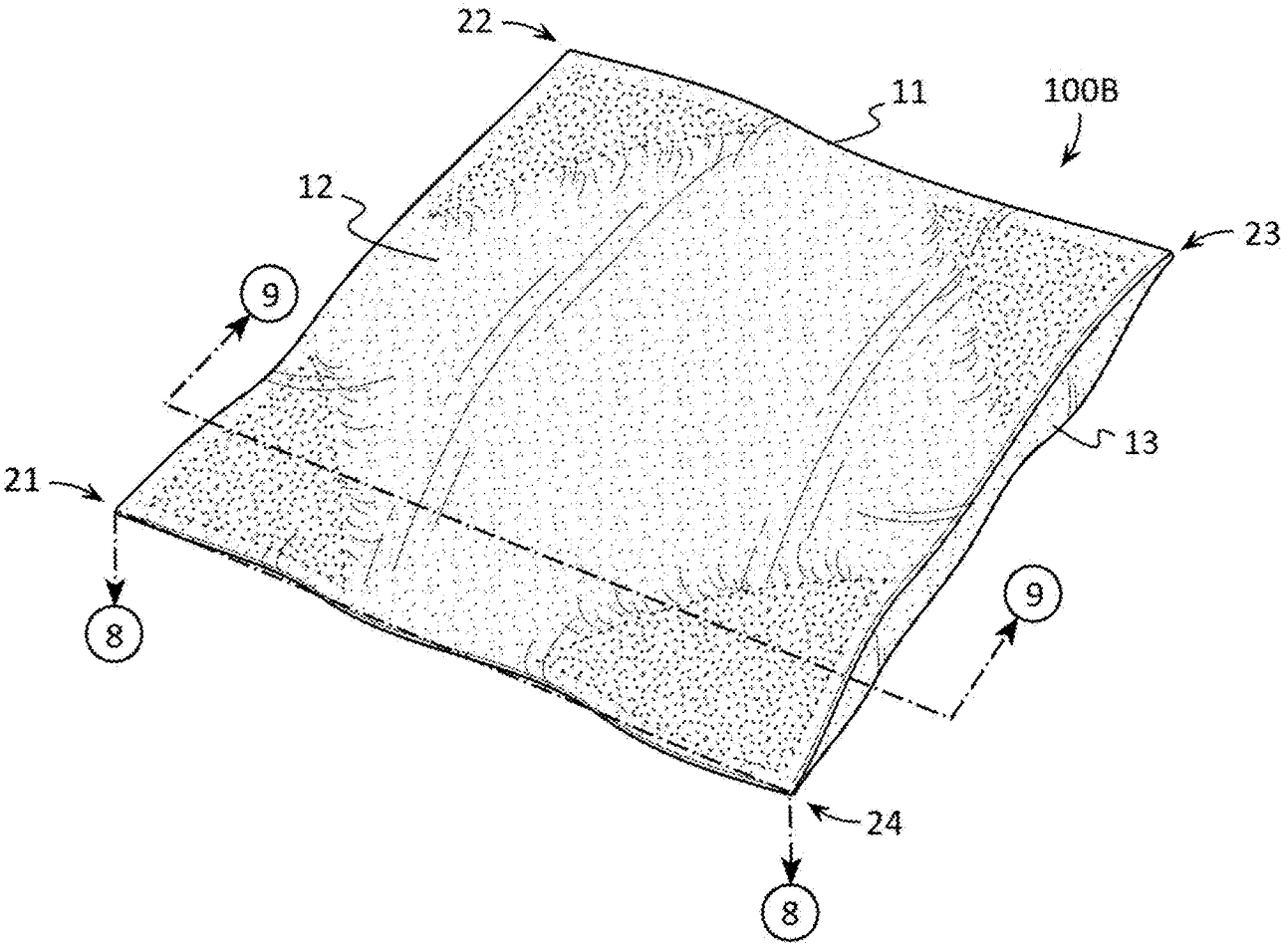
FIG. 7 depicts a perspective view of a further example of a game bag device with texturing to show the positioning of four core structures within a body cavity according to various embodiments described herein.
Figure 8:
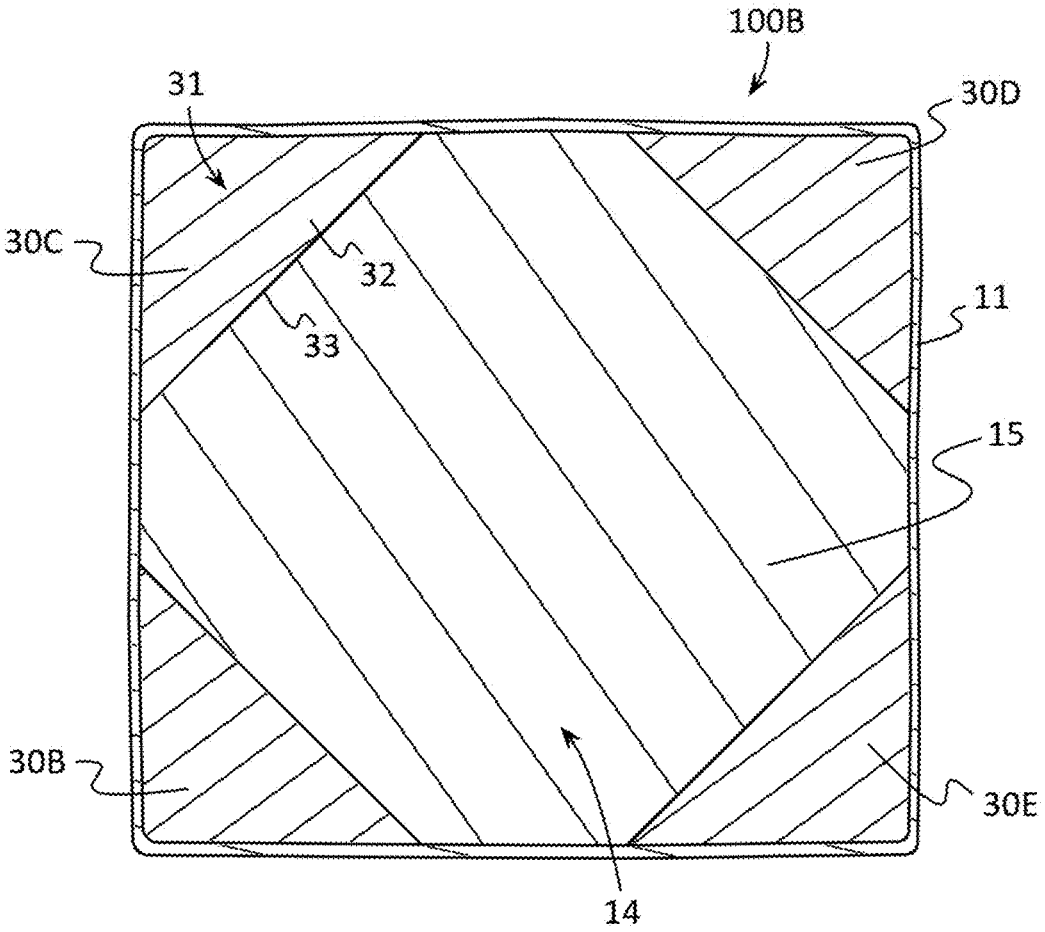
FIG. 8 illustrates a sectional, through line 8-8 shown in FIG. 7, plan view of a further example of a game bag device according to various embodiments described herein.
Figure 9:
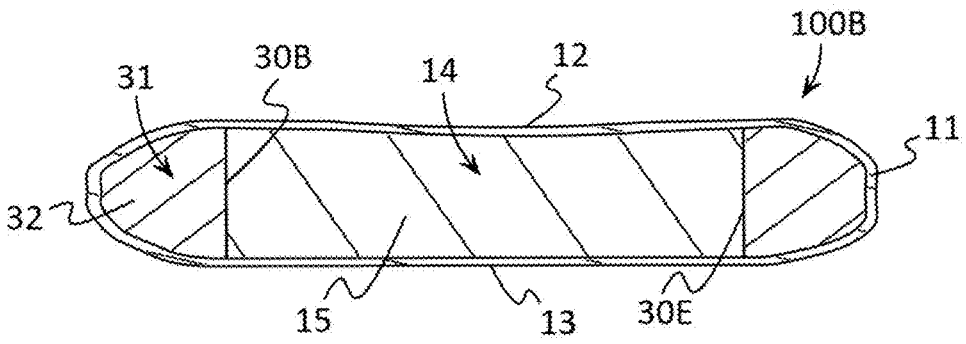
FIG. 9 shows a sectional, through line 9-9 shown in FIG. 7, elevation view of a further example of a game bag device according to various embodiments described herein.
Figure 10:
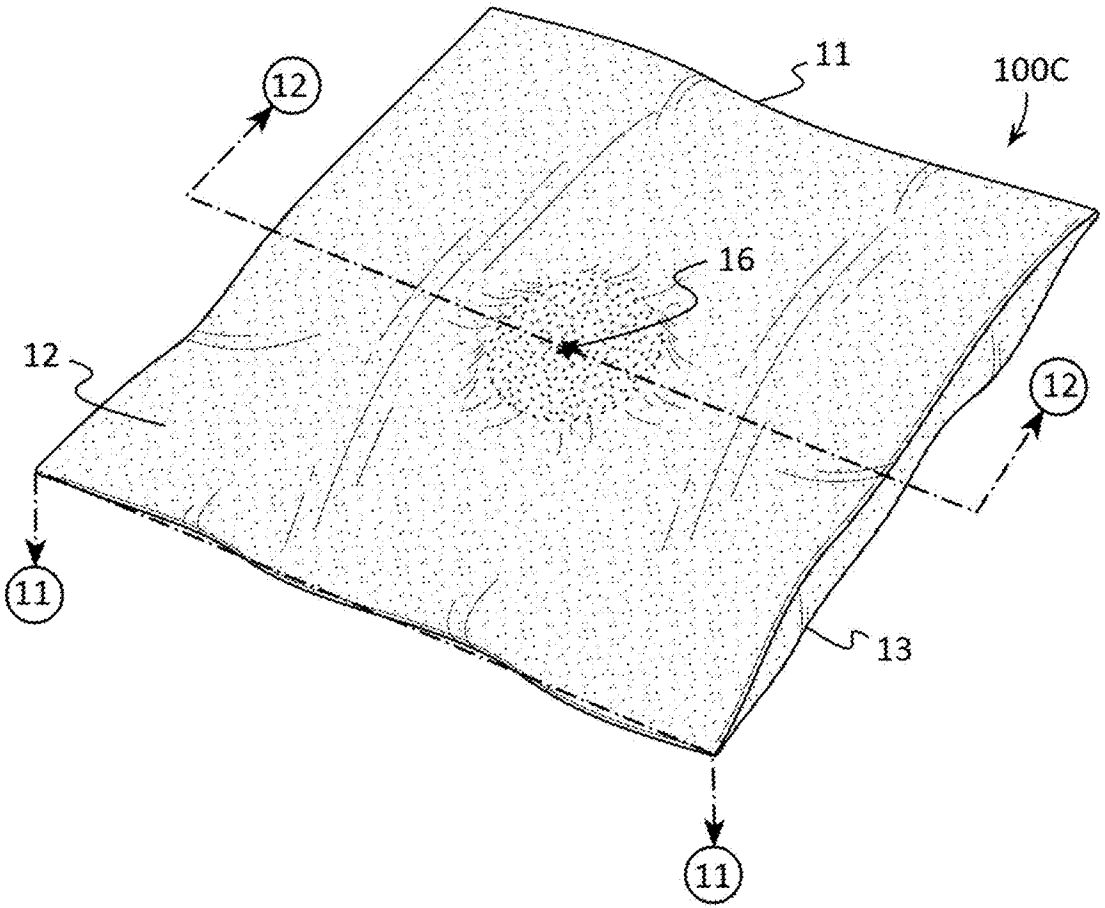
FIG. 10 depicts a perspective view of yet another example of a game bag device with texturing to show the positioning of a core structure within a body cavity according to various embodiments described herein.
Figure 11:
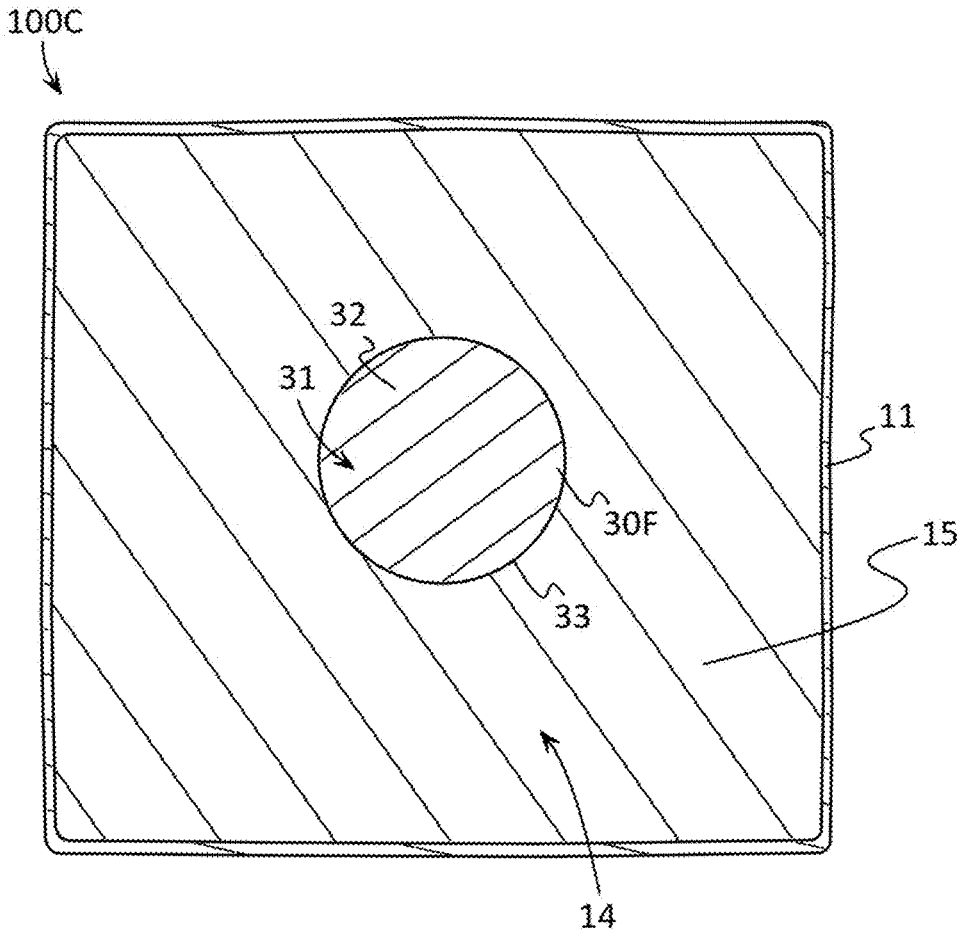
FIG. 11 illustrates a sectional, through line 11-11 shown in FIG. 10, plan view of yet another example of a game bag device according to various embodiments described herein.

Preferably, each core structure 30 may comprise one or more core sidewalls 33 which may form one or more core cavities 31. Optionally, a core structure 30 may comprise one or more apertures 34 which may comprise an opening of any size and shape that may extend through the core structure 30. Core sidewalls 33 may be configured in any size and shape and may be coupled together or formed with any suitable coupling method to form a core structure 30 and core cavity 31 of any size and shape. For example, and as shown in FIGS. 4-6, a core structure 30 may comprise a tubular circle or oval shape having a generally circular or oval shaped aperture 34. As another example, and as shown in FIGS. 1-3 and 16-18, a core structure 30 may comprise a tubular square or rectangular shape having a square or rectangular shaped aperture 34. As another example, and as shown in FIGS. 10-15, a core structure 30 may comprise a cylindrical shape. As another example, and as shown in FIGS. 7-9, a core structure 30 may comprise a triangular prism shape. As another example, a core structure 30 may comprise an X-shape, zigzag shape, or any other shape.

In some embodiments, the device 100, 100A, 100B, 100C, 100D, 100E, may comprise one or more relatively larger core structures 30. For example, and as perhaps best shown in FIG. 3, a core structure 30 may comprise a width dimension (CW), describing its largest dimension or length, and a sidewall 12, 13, such as the first sidewall 12 may comprise a width dimension (SW), describing its largest dimension or length, and the CW may be at least fifty percent of the SW.

In some embodiments, the device 100, 100A, 100B, 100C, 100D, 100E, may comprise one or more relatively smaller core structures 30. For example, and as perhaps best shown in FIG. 12, a core structure 30F may comprise a width dimension (CW), describing its largest dimension or length, and a sidewall 12, 13, such as the first sidewall 12 may comprise a width dimension (SW), describing its largest dimension or length, and the CW may be less than fifty percent of the SW.

Figure 12:
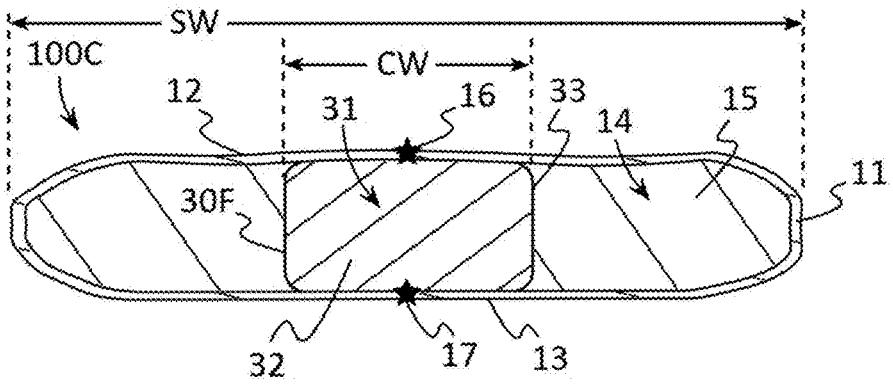
FIG. 12 shows a sectional, through line 12-12 shown in FIG. 10, elevation view of yet another example of a game bag device according to various embodiments described herein.
Figure 13:
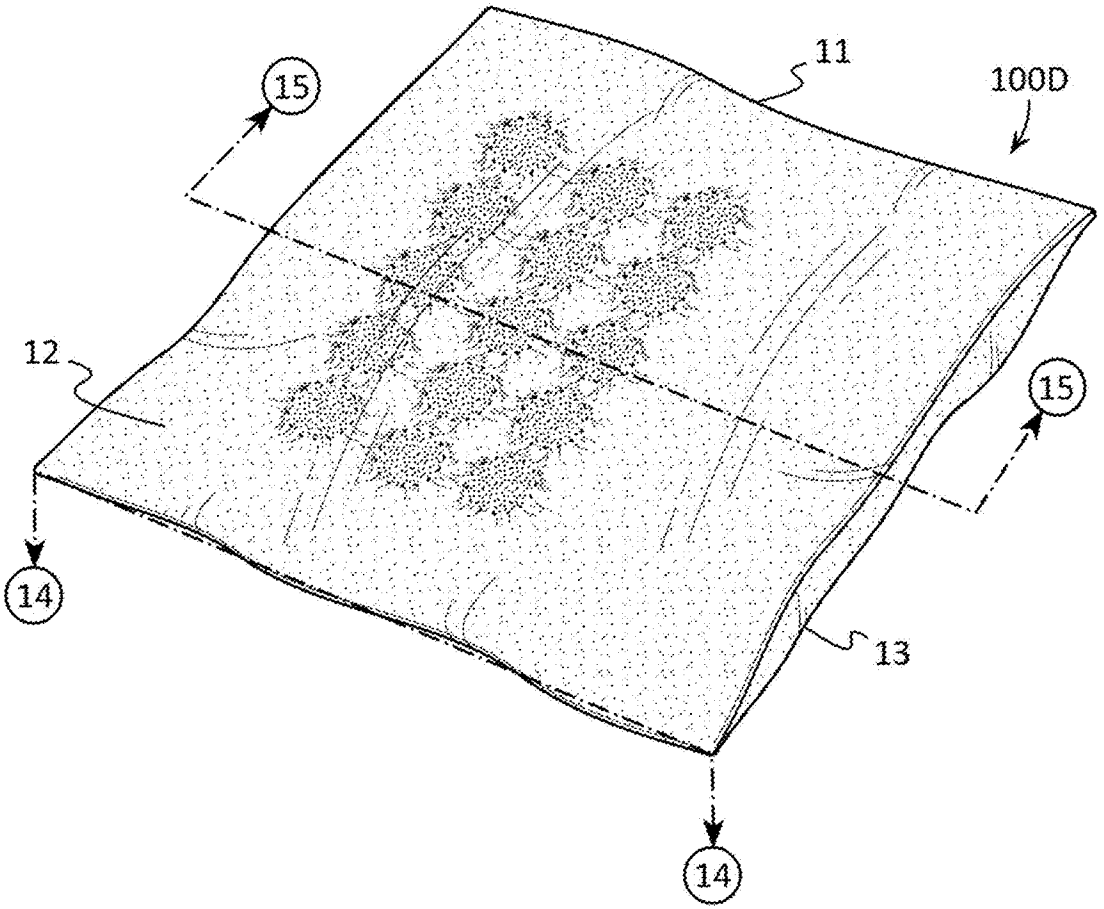
FIG. 13 depicts a perspective view of still yet another example of a game bag device with texturing to show the positioning of fifteen core structures within a body cavity according to various embodiments described herein.
Figure 14:
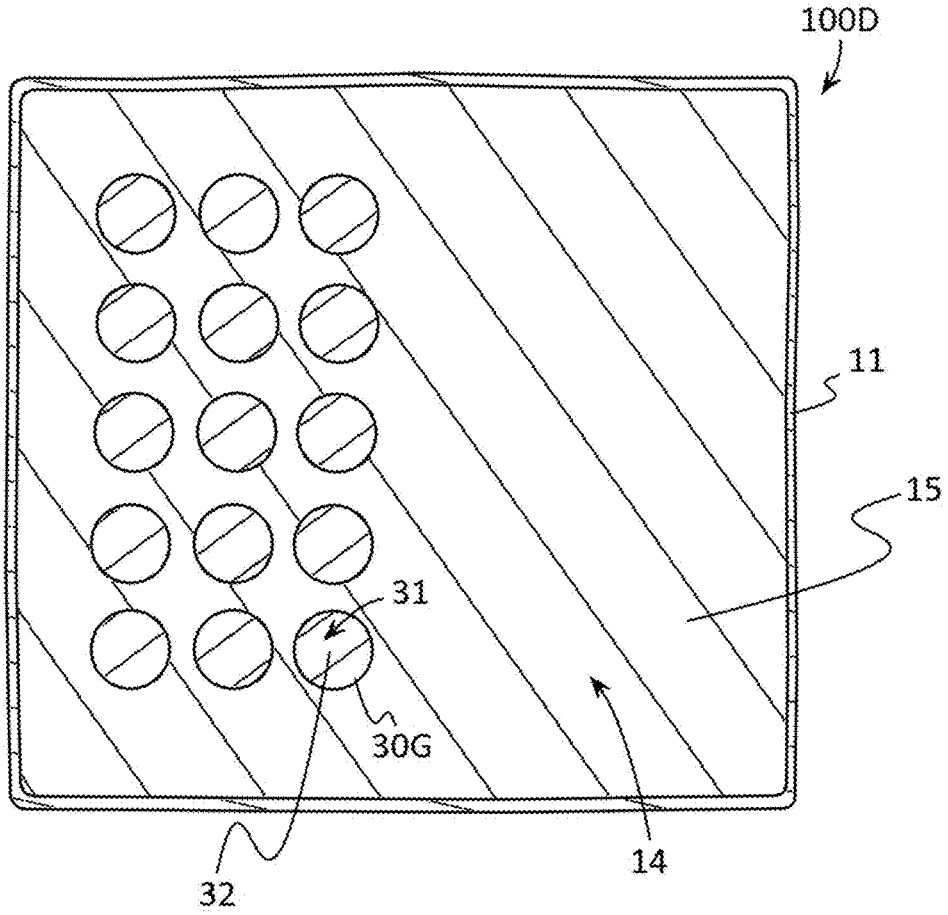
FIG. 14 illustrates a sectional, through line 14-14 shown in FIG. 13, plan view of still yet another example of a game bag device according to various embodiments described herein.
Figure 15:
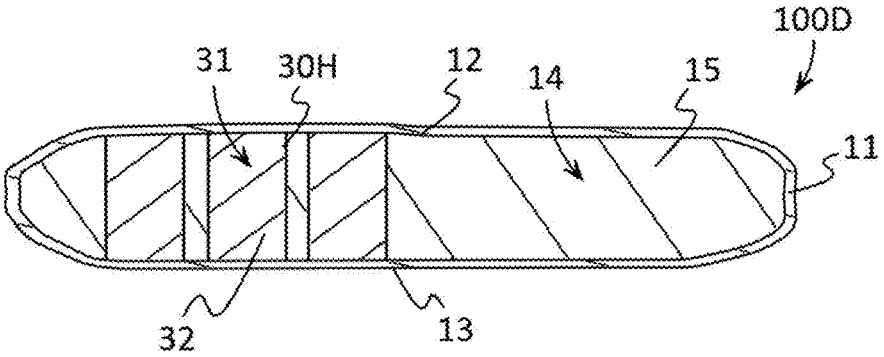
FIG. 15 shows a sectional, through line 15-15 shown in FIG. 13, elevation view of still yet another example of a game bag device according to various embodiments described herein.

In some embodiments, a core structure 30 may be positioned within a body cavity 14 without being coupled to a body sidewall 12, 13, so that the core structure 30 may be "free floating" with the body filler 15 in the body cavity 14. In further embodiments, a core structure 30 may be positioned within a body cavity 14 and may be coupled to one or more body sidewalls 12, 13, so that the core structure 30 may not be "free floating" with the body filler 15 in the body cavity 14. For example, and referring to FIG. 3, a core structure 30 may not be attached to an upper or first sidewall 12 and may be attached to the bottom or second sidewall 13 allowing a body filler 15 to move into and out of the aperture 34. In further embodiments, and as shown in FIG. 12, a first sidewall 12 may comprise a first center point 16 (approximately the center of the first sidewall 12 shape), a second sidewall 13 may comprise a second center point 17, and a core structure 30F may be coupled to the first center point 16 and/or to the second center point 17.

In some embodiments, the device 100, 100A, 100B, 100C, 100D, 100E, may comprise one or more core structures 30 which may be coupled to or proximate to one or more corners 21, 22, 23, 24, by being coupled to a first 12 and/or second 13 body sidewall proximate to the one or more corners 21, 22, 23, 24. For example, and as shown in FIGS. 7-9, the device 100B, may comprise a first core structure 30B that may be coupled to or proximate to the first corner 21, a second core structure 30C that may be coupled to or proximate to the second corner 22, a the third core structure 30D that may be coupled to or proximate to the third corner 23, and a fourth core structure 30E that may be coupled to or proximate to the fourth corner 24. In further embodiments, a core structure 30 may be coupled to a first 12 and/or second 13 body sidewall between two corners 21, 22, 23, 24.

In some embodiments, a core sidewall 33 may be made from or may comprise a flexible material which may allow the shape of its core structure 30 to be generally fluid and easily bent, folded, bunched, etc. For example, a core sidewall 33 may be made from or may comprise a flexible cloth material, such as woven cotton fabric, woven linen fabric, woven polyester fabric, neoprene fabric, elastomeric coated fabric, microfiber fabrics, suede, other woven fabrics, other non-woven fabrics, other knitted fabrics, or some other strong and durable material known in the art. In further embodiments, a core sidewall 33 may be made from or may comprise a resilient material which regain its shape after being deformed. For example, a core sidewall 33 may be made from or may comprise a resilient plastic material, resilient rubber material, etc.

Each core structure 30 may comprise a core cavity 31 which may be formed by the one or more core sidewalls 33 of each core structure 30. A core cavity 31 may comprise a core filler 32. In some embodiments, a core filler 32 and a core sidewall 33 of a core structure 30 may comprise the same material. For example, a core filler 32 and a core sidewall 33 of a core structure 30 may comprise a neoprene foam material so that the core filler 32 and a core sidewall 33 may be integrally formed together.

In preferred embodiments, a core filler 32 may comprise a plurality of small objects or particles which may act as a fluid or undergo fluid movement within a core cavity 31. For example, a core filler 32 may comprise dry corn feed, dry beans, plastic pellets, plastic spheres, rubber pellets, rubber spheres, styrene pellets, styrene spheres, polystyrene pellets, polystyrene spheres, or some other similar filling. A core filler 32 may comprise a core average particle size which may describe the average particle size or volume of the individual particles of the core filler 32. For example, core average particle size may range from 0.1 to 15 millimeters, although any size may be used. A core filler 32 may comprise a core average particle weight which may describe the average particle weight of the individual particles of the core filler 32. A core filler 32 may comprise a core density which may be determined by the mass of the core filler 32 divided by the volume of the core cavity 31 that the core filler 32 is able to move in or occupy.

In some embodiments, the device 100, 100A, 100B, 100C, 100D, 100E, may comprise a core filler 32 and a body filler 15, and there may be at least a five percent difference, such as a ten percent difference, 50 percent difference, 100 percent difference, 200 percent difference, 700 percent difference, etc., between the core average particle size and the body average particle size. For example, the core average particle size may be approximately at least five percent larger than the body average particle size. In further embodiments, there may be less than a five percent difference between the core average particle size and the body average particle size. For example, the core average particle size may be approximately equal to the body average particle size.

In some embodiments, the device 100, 100A, 100B, 100C, 100D, 100E, may comprise a core filler 32 and a body filler 15, and there may be at least a five percent difference, such as a ten percent difference, 50 percent difference, 100 percent difference, 200 percent difference, 700 percent difference, etc., between the core average particle weight and the body average particle weight. For example, the core average particle weight may be approximately at least five percent heavier than the body average particle weight. In further embodiments, there may be less than a five percent difference between the core average particle weight and the body average particle weight. For example, the core average particle weight may be approximately equal to the body average particle weight.

In some embodiments, the device 100, 100A, 100B, 100C, 100D, 100E, may comprise a core filler 32 and a body filler 15, and there may be at least a five percent difference, such as a ten percent difference, 50 percent difference, 100 percent difference, 200 percent difference, 700 percent difference, etc., between the core density and the body density. For example, the core density may be approximately at least five percent lesser than the body density. In further embodiments, there may be less than a five percent difference between the core average particle weight and the body average particle weight. For example, the core density may be approximately equal to the body density.

In some embodiments, and as shown in FIGS. 2, 3, 5, and 6, the device 100, 100A, may comprise an aperture cavity 35 which may be formed by a core structure 30, 30A, having an aperture 34 in which the core structure 30, 30A, is coupled to the first 12 and second 13 sidewalls so that the aperture cavity 35 is formed within the aperture 34 between the first sidewall 12 and the second sidewall 13. As an aperture 34 may be configured in any shape and size, an aperture cavity 35 may be configured in any shape and size.

Figure 16:
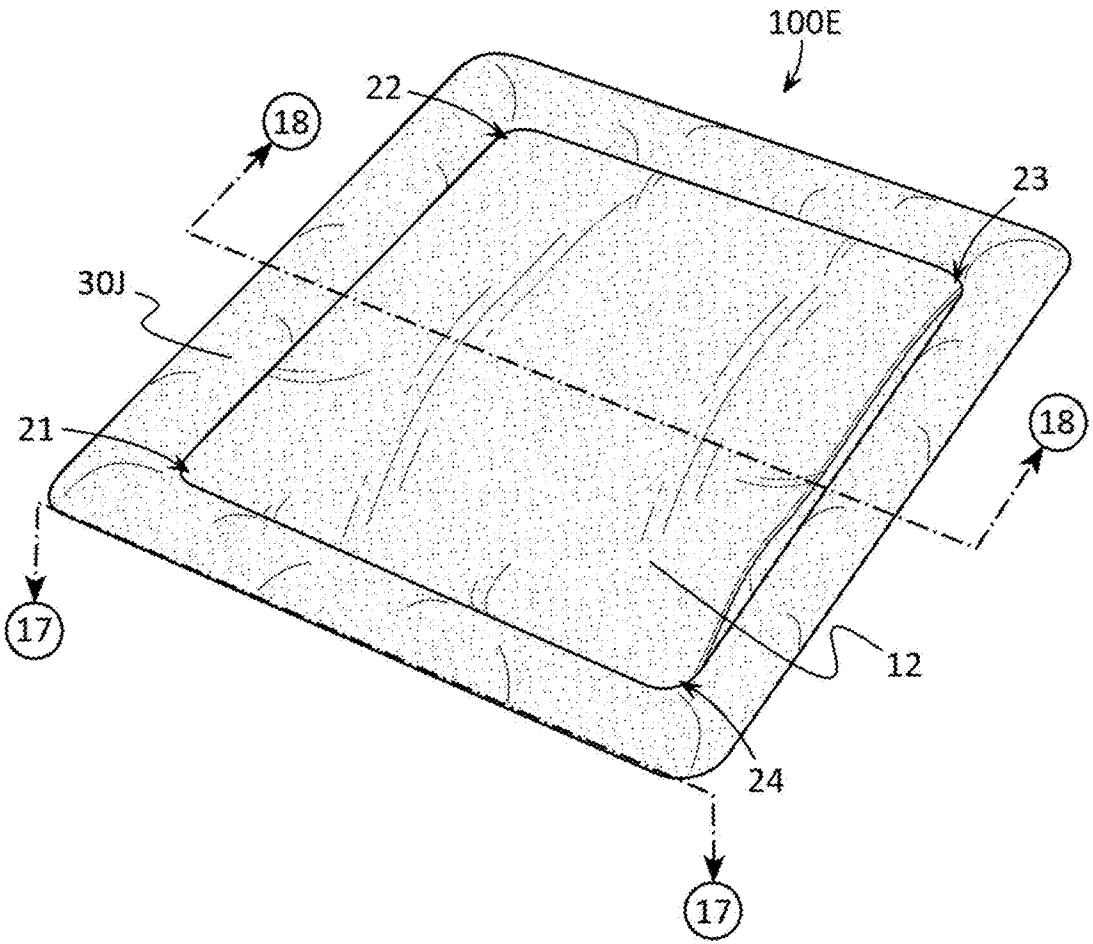
FIG. 16 depicts a perspective view of still yet a further example of a game bag device with a core structure external to a body cavity according to various embodiments described herein.
Figure 17:
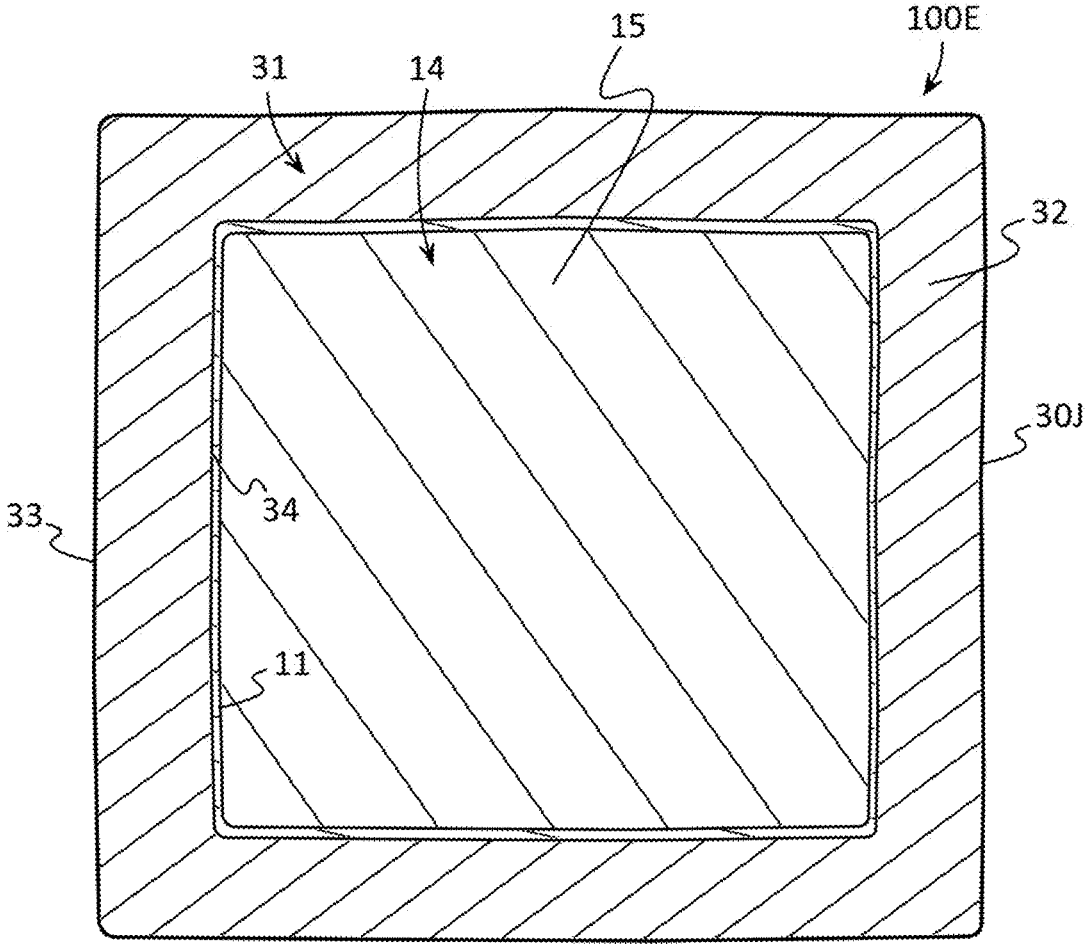
FIG. 17 illustrates a sectional, through line 17-17 shown in FIG. 16, plan view of still yet a further example of a game bag device according to various embodiments described herein.
Figure 18:
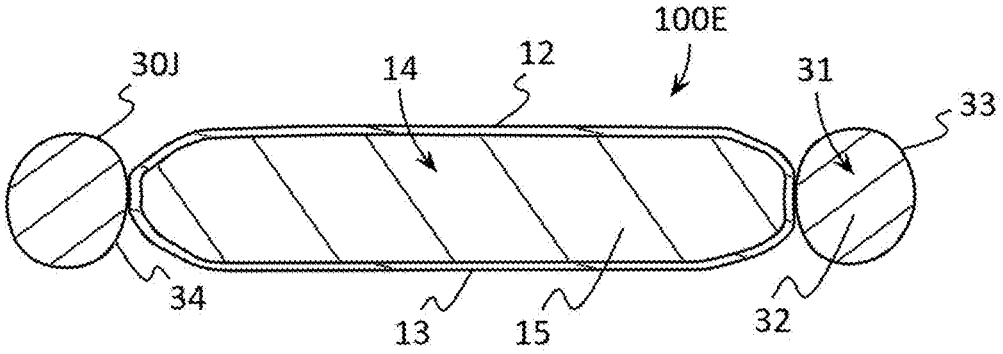
FIG. 18 shows a sectional, through line 18-18 shown in FIG. 16, elevation view of still yet a further example of a game bag device according to various embodiments described herein.

In some embodiments, aperture cavity 35 may comprise an aperture filler 36 (FIGS. 1-6). In further embodiments, a body 11 may be coupled to a core structure 30J by being coupled within an aperture cavity 35 (FIGS. 16-18). In preferred embodiments, an aperture filler 36 may comprise a plurality of small objects or particles which may act as a fluid or undergo fluid movement within an aperture cavity 35. For example, an aperture filler 36 may comprise dry corn feed, dry beans, plastic pellets, plastic spheres, rubber pellets, rubber spheres, styrene pellets, styrene spheres, polystyrene pellets, polystyrene spheres, or some other similar filling. An aperture filler 36 may comprise an aperture average particle size which may describe the average particle size or volume of the individual particles of the aperture filler 36. For example, aperture average particle size may range from 0.1 to 15 millimeters, although any size may be used. An aperture filler 36 may comprise an aperture average particle weight which may describe the average particle weight of the individual particles of the aperture filler 36. An aperture filler 36 may comprise an aperture density which may be determined by the mass of the aperture filler 36 divided by the volume of the aperture cavity 35 that the aperture filler 36 is able to move in or occupy.

In some embodiments, the device 100, 100A, may comprise an aperture filler 36 along with a core filler 32 and/or a body filler 15, and there may be at least a five percent difference, such as a ten percent difference, 50 percent difference, 100 percent difference, 200 percent difference, 700 percent difference, etc., between the aperture average particle size and the core average particle size and/or the body average particle size. For example, the aperture average particle size may be approximately at least five percent smaller than the core average particle size and/or the body average particle size. In further embodiments, there may be less than a five percent difference between the aperture average particle size and the core average particle size and/or the body average particle size. For example, the core average particle size may be approximately equal to the core average particle size and/or the body average particle size.

In some embodiments, the device 100, 100A, may comprise an aperture filler 36 along with a core filler 32 and/or a body filler 15, and there may be at least a five percent difference, such as a ten percent difference, 50 percent difference, 100 percent difference, 200 percent difference, 700 percent difference, etc., between the aperture average particle weight and the core average particle weight and/or the body average particle weight. For example, the aperture average particle weight may be approximately at least five percent lighter than the core average particle weight and/or the body average particle weight. In further embodiments, there may be less than a five percent difference between the aperture average particle weight and the core average particle weight and/or the body average particle weight. For example, the aperture average particle weight may be approximately equal to the core average particle weight and/or the body average particle weight.

In some embodiments, the device 100, 100A, may comprise an aperture filler 36 along with a core filler 32 and/or a body filler 15, and there may be at least a five percent difference, such as a ten percent difference, 50 percent difference, 100 percent difference, 200 percent difference, 700 percent difference, etc., between the aperture density and the core density and/or the body density. For example, the aperture density may be approximately at least five percent greater than the core density and/or the body density. In further embodiments, there may be less than a five percent difference between the aperture density and the core density and/or the body density. For example, the aperture density may be approximately equal to the core density and/or the body density.

While a body filler 15, core filler 32, and aperture filler 36 may comprise any suitable type of small objects or particles which may act as a fluid or undergo fluid movement, some example materials are provided. As a first example, a filler 15, 32, 36, may comprise a two-millimeter (average particle size) plastic sphere or spheroid having a solid core and a weight of 0.1 grams (average particle weight). As a second example, a filler 15, 32, 36, may comprise a two-millimeter dense plastic sphere or spheroid having a solid core and a weight of 0.15 grams. As a third example, a filler 15, 32, 36, may comprise a four-millimeter plastic sphere or spheroid having a solid core and a weight of 0.2 grams. As a fourth example, a filler 15, 32, 36, may comprise an eight-millimeter plastic sphere or spheroid having a hollow core and a weight of 0.15 grams. As a fourth example, a filler 15, 32, 36, may comprise an eight-millimeter plastic sphere or spheroid having a hollow core and a weight of 0.15 grams. As a fifth example, a filler 15, 32, 36, may comprise a two-millimeter plastic coated metal sphere or spheroid having a weight of 0.6 grams. While in some embodiments, one or more of the body filler 15, core filler 32, and aperture filler 36 may comprise substantially the same average particle size, average particle weight, and/or density, in further embodiments, one or more of the body filler 15, core filler 32, and aperture filler 36 may comprise an average particle size, average particle weight, and/or density that is at least five percent different than that of the one or more other fillers 15, 32, 36.

While some exemplary shapes and sizes have been provided for elements of the device 100, 100A, 100B, 100C, 100D, 100E, it should be understood to one of ordinary skill in the art that the body 11, core structures 30, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100, 100A, 100B, 100C, 100D, 100E, may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100, 100A, 100B, 100C, 100D, 100E, may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100, 100A, 100B, 100C, 100D, 100E, may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100, 100A, 100B, 100C, 100D, 100E, may be coupled by being one of connected to and integrally formed with another element of the device 100, 100A, 100B, 100C, 100D, 100E.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A game bag device, the device comprising:

a first sidewall;

a second sidewall coupled to the first sidewall to form a body cavity;

a core structure defining a core cavity, the core structure having an aperture;

a core filler disposed within the core cavity;

a body filler disposed within the body cavity; and wherein the core structure is coupled to at least one of the first sidewall and the second sidewall and an aperture cavity is formed within the aperture between the first sidewall and the second sidewall and an aperture filler is disposed within the aperture cavity, the aperture filler comprising an aperture density, the body filler comprising a body density, and wherein there is at least a five percent difference between the aperture density and the body density.

2. The device of claim 1, wherein the core filler comprises a core average particle size, wherein the body filler comprises a body average particle size, and wherein there is at least a five percent difference between the core average particle size and the body average particle size.

3. The device of claim 1, wherein the core filler comprises a core average particle weight, wherein the body filler comprises a body average particle weight, and wherein there is at least a five percent difference between the core average particle weight and the body average particle weight.

4. The device of claim 1, wherein the core filler comprises a core density, and wherein there is at least a five percent difference between the core density and the body density.

5. The device of claim 1, wherein the core structure is coupled to a sidewall selected from the first sidewall and the second sidewall.

6. The device of claim 1, wherein the core structure comprises a width dimension (CW) and the first sidewall comprises a width dimension (SW), and wherein the CW is at least fifty percent of the SW.

7. A game bag device, the device comprising:

a first sidewall;

a second sidewall coupled to the first sidewall to form a body cavity;

a core structure defining a core cavity, the core structure having an aperture;

a core filler disposed within the core cavity;

a body filler disposed within the body cavity; and wherein the core structure is coupled to at lease one of the first sidewall and the second sidewall and an aperture cavity is formed within the aperture between the first sidewall and the second sidewall and an aperture filler is disposed within the aperture cavity, the aperture filler comprising an aperture density, the core filler comprising a core density, and wherein there is at least a five percent difference the aperture density and the body core density.

* * * * *